US005168450A

United States Patent [19]

Ohkubo et al.

[11] Patent Number: 5,168,450

[45] Date of Patent: Dec. 1, 1992

[54] LEARNING CONTROL SYSTEM FOR THE THROTTLING OF INTERNAL COMBUSTION ENGINE

[75] Inventors: Daiji Ohkubo, Fujisawa; Shunsuke Kuroki, Yokohama, both of Japan

[73] Assignee: Isuzu Motors Limited, Japan

[21] Appl. No.: 744,825

[22] Filed: Aug. 12, 1991

Related U.S. Application Data

[63] Continuation of Ser. No. 487,107, Mar. 2, 1990, abandoned.

[30] Foreign Application Priority Data

Mar. 3, 1989 [JP] Japan ..... 1-51031

[51] Int. Cl.[5] ..... F02D 41/24; F02D 45/00; F02D 31/00

[52] U.S. Cl. ..... 364/431.11; 364/424.03; 364/431.05; 123/350; 123/358; 123/361; 318/563; 318/565; 318/626

[58] Field of Search ..... 364/431.05, 431.03, 364/424.1, 431.11, 424.03, 431.01, 431.04; 123/358, 361, 585, 340, 350, 352; 318/563, 565, 567, 569, 572, 626

[56] References Cited

U.S. PATENT DOCUMENTS 4,513,710 4/1985 Kobayashi et al. .
4,586,471 5/1986 Horada et al. ..... 123/361 X
4,590,906 5/1986 Uriuhara et al. ..... 123/399 X
4,637,361 1/1987 Killen et al. ..... 123/361 X
4,823,749 4/1989 Eisenmann et al. ..... 123/361 X

FOREIGN PATENT DOCUMENTS 0239524 3/1987 European Pat. Off. .

OTHER PUBLICATIONS

Patent Abstracts of Japan, vol. 10, No. 83 (M-466) [2140], Apr. 2, 1986; & JP-A-59 82 761 (Nippon Denso K.K.) Nov. 9, 1985.
Patent Abstracts of Japan, vol. 12, No. 274 (M-725), Jul. 29, 1988; & JP-A-63 057 845 (Isuzu Motor Ltd).

*Primary Examiner*—Parshotam S. Lall
*Assistant Examiner*—Edward J. Pipala
*Attorney, Agent, or Firm*—Staas & Halsey

[57] ABSTRACT

A learning control system for controlling the throttling of an internal combustion engine includes a step motor for operating the throttling lever of a fuel supply device which supplies fuel to the internal combustion engine. Each time the number of steps for driving the step motor is incremented, the rotational speed of the engine is detected and compared with a preset maximum engine rotational speed. When the rotational speed of the engine reaches the preset maximum engine rotational speed, the number of steps is stored as the number of steps for driving the step motor at the time the accelerator pedal is fully depressed.

4 Claims, 2 Drawing Sheets

LEARNING CONTROL SYSTEM FOR THE THROTTLING OF INTERNAL COMBUSTION ENGINE

This application is a continuation of application Ser. No. 07/487,107, filed Mar. 3, 1990, now abandoned.

BACKGROUND OF THE INVENTION

The present invention relates to a learning control system for controlling the throttling of an internal combustion engine, the learning control system including a step motor for operating the throttling lever of a fuel supply device which supplies fuel to the internal combustion engine.

There have recently been put to use motor vehicles which incorporate an electronic controller having a microcomputer for controlling an internal combustion engine, a power transmission apparatus, etc.

In such an electronically controlled motor vehicle, the amount of depression of the accelerator pedal operated on by the driver is converted by an accelerator pedal movement sensor into an electric signal which is applied to the electronic control system. The electronic controller then converts the applied electric signal into a step motor drive signal. The step motor drive signal is applied to a step motor which actuates the throttling lever of a fuel supply device that supplies fuel to the internal combustion engine. The throttling control system of such an arrangement includes a fully throttling position switch which coacts with the throttling lever when it is in a fully throttling position. In response to a signal from the fully throttling position switch, the electronic controller detects the fully throttling position of the throttling lever, and then stops applying the step motor drive signal and energizes the coil in the step motor to keep the throttling lever in the fully throttling position. If the fully throttling position switch fails to operate for some reason, then the throttling lever may not be stopped in the fully throttling position, and hence the internal combustion engine may rotate at an extremely high speed, resulting in an undesirable breakdown.

To solve the above problem, there has been proposed a throttling control system for an internal combustion engine, as disclosed in Japanese Patent Application No. 63(1988)-263664. According to the proposed throttling control system, when the fully throttling position switch fails to operate, the opening limit position for the throttling lever, which has so far been the position where the fully throttling position switch is actuated, is set to a preset opening position.

With the proposed throttling control system, therefore, if the fully throttling position switch malfunctions, then the preset opening position is used as a new opening limit position for the throttling lever. Consequently, the internal combustion engine is protected from a possible breakdown and the motor vehicle is allowed to run safely.

Throttling lever actuating mechanisms are generally subject to different manufacturing errors. The steps that step motors have to be incremented to operate the throttling lever in its operating range from the idling position to the fully throttling position may vary from 164 steps to 230 steps. More specifically, the step motor of one throttling lever actuating mechanism may be incremented only 164 steps to move the throttling lever to the fully throttling position in which the engine speed reaches the maximum speed of 4,200 rpm, for example. The step motor of another throttling lever actuating mechanism may be required to be incremented 230 steps before the throttling lever reaches the fully throttling position. Therefore, even if a signal corresponding to 164 steps is supplied to the latter throttling lever actuating mechanism, it cannot move the throttling lever to its maximum position, i.e., the fully throttling position. On the other hand, if a control signal corresponding to 230 steps is supplied to the former throttling lever actuating mechanism, then the throttling lever is forced against the stopper in the opening limit position, causing the step motor to suffer hunting or get out of control and making it impossible to control the throttling lever.

One proposal to cope with the failure of the fully throttling position switch is to include a safety margin when the opening limit position for the throttling lever is changed to the preset opening position. However, since the safety margin necessarily puts the preset opening position below the lower limit of the above range from 164 steps to 230 steps, the maximum output power of the engine cannot be achieved when the preset opening position is selected as the opening limit position for the throttling lever.

SUMMARY OF THE INVENTION

It is an object of the present invention to provide a learning control system for controlling the throttling of an internal combustion engine, the learning control system being capable of controlling the throttling lever for a fully throttling position through a learning process without the need for a fully throttling position switch, and being adapted for use with throttling lever actuating mechanisms of different manufacturing errors.

According to the present invention, there is provided a learning control system for controlling the throttling of an internal combustion engine on a motor vehicle, comprising a fuel supply device for supplying fuel to the internal combustion engine, the fuel supply device having a throttling lever for controlling the rate at which the fuel is supplied to the internal combustion engine, a step motor for actuating the throttling lever, means for controlling the step motor depending on the amount of depression of an accelerator pedal, an accelerator pedal movement sensor for detecting the amount of depression of the accelerator pedal, an engine speed sensor for detecting the rotational speed of the internal combustion engine, step incrementing means for incrementing the number of steps for driving the step motor when the accelerator pedal is fully depressed, comparing means for comparing the engine rotational speed detected by the engine speed sensor with a preset maximum engine rotational speed each time the number of steps for driving the step motor is incremented, learning means for determining the number of steps for driving the step motor when the engine rotational speed has reached the preset maximum engine rotational speed as determined by the comparing means, and memory means for storing the number of steps determined by the learning means as the number of steps at the time the accelerator pedal is fully depressed.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
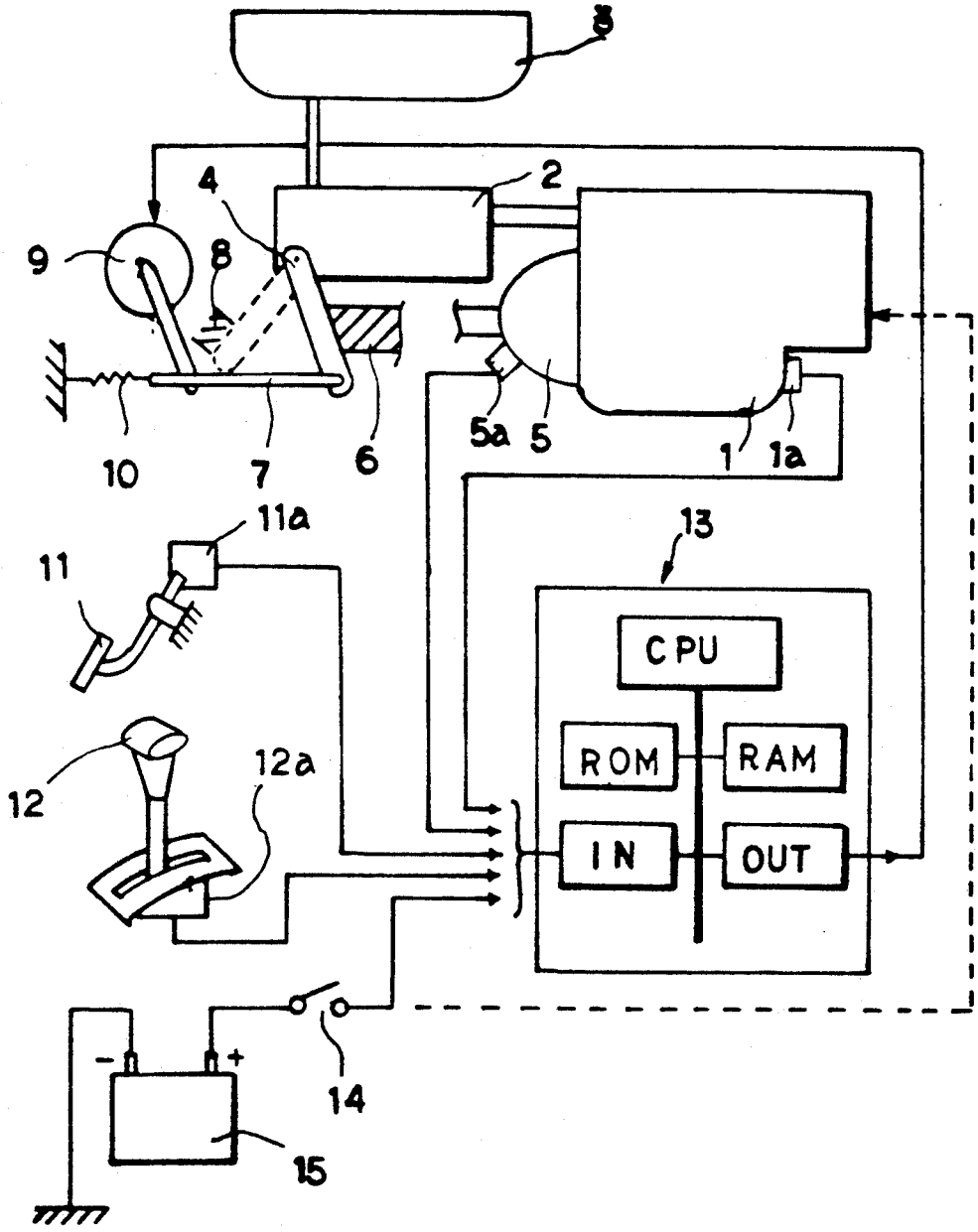
FIG. 1 is a schematic view, partly in block form, of a learning control system for the throttling of an internal combustion engine according to an embodiment of the present invention.

FIG. 1 schematically shows a learning control system for controlling the throttling of an internal combustion engine according to an embodiment of the present invention.

An internal combustion engine 1, such as a gasoline engine or a diesel engine, is mounted on a motor vehicle. Output power produced by the internal combustion engine 1 is transmitted to road wheels (not shown) through a power transmission apparatus such as a transmission 5. The internal combustion engine 1 is supplied with fuel from a fuel tank 3 through a fuel supply device 2 such as a fuel atomizer or a fuel injection pump. The fuel supply device 2 has a throttling lever 4 for controlling the rate at which the fuel is supplied to the engine 1. A step motor 9 is operatively coupled to the throttling lever 4 through a link 7. The step motor 9 is controlled in its operation by a control signal from an electronic controller 13. A fully throttling position for the throttling lever 4 is defined by a fully throttling position stopper 6, and an idling position for the throttling lever 4 is defined by an idling position stopper 8. A return spring 10 is connected between the throttling lever 4 and a fixed member, for normally urging the link 7 to the left (FIG. 1) to return the throttling lever 4 to the idling position.

The rotational speed of the internal combustion engine 1 is detected by an engine speed sensor 1a. The running speed of the motor vehicle is detected by a vehicle speed sensor 5*a*. The amount of depression of an accelerator pedal 11 is detected by an accelerator pedal movement sensor 11*a*. The gear position which is selected by a gear selector lever 12 is detected by a selected gear sensor 12*a*. Detected signals from these sensors 1*a*, 5*a*, 11*a*, 12*a* are applied to the electronic controller 13.

When the internal combustion engine 1 is to be started, DC electric power supply stored in a battery 15 on the motor vehicle is supplied through an ignition key 14 which is turned on to a starter (not shown) of the engine 1. When the ignition key 14 is turned on, the electronic controller 13 is also energized by the battery 15.

The electronic controller 13 comprises a microcomputer including a central processing unit (CPU), memories such as a ROM and a RAM for storing calculating processes, a control process, the results of the calculating processes, the number of steps which is learned, and other data, and input/output ports. When the detected signals from the sensors are supplied to the electronic controller 13, the electronic controller 13 effects predetermined calculations and generates and applies a control signal to the step motor 9 according to the stored control process.

Figure 2:
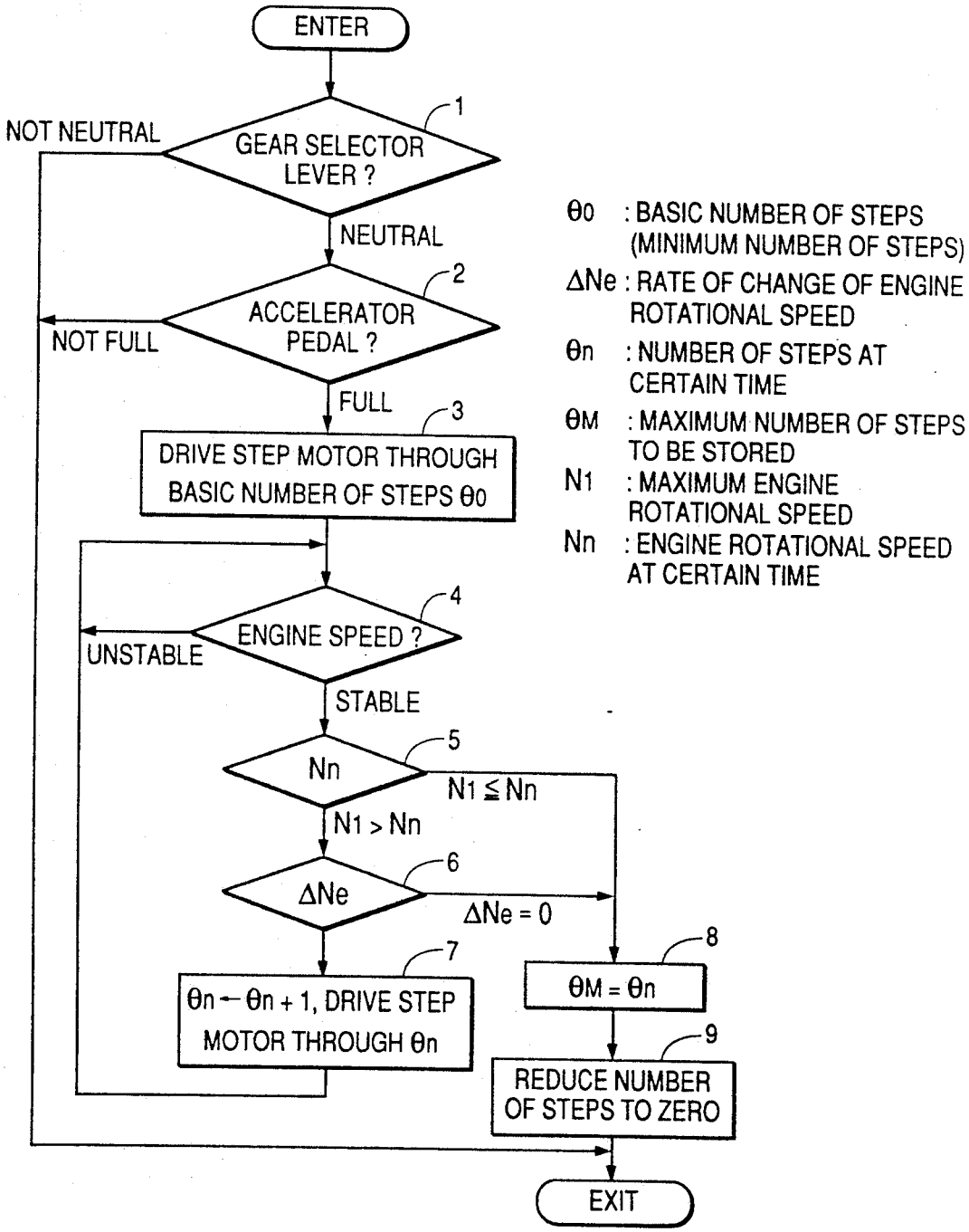
FIG. 2 is a flowchart of a processing sequence of the learning control system of the present invention.

Operation of the learning control system thus constructed will be described below with reference to the flow chart shown in FIG. 2.

In a step 1, the electronic controller 13 checks the selected gear position of the gear selector lever 12 based on the signal from the selected gear sensor 12*a*. If the gear selector lever 12 is in a neutral position, then the electronic controller 13 checks the detected signal from the accelerator pedal movement sensor 11*a* in a step 2. If the accelerator pedal 11 is fully depressed, i.e., if the amount of depression of the accelerator pedal 11 is maximum, in the step 2, then the electronic controller 13 increments the step motor 9 through a basic number of steps $\theta$ in a step 3 to move the throttling lever 4 toward the fully throttling position stopper 6. The basic number of steps $\theta$ is a minimum number of steps which the step motor 9 is at least required to be incremented and which is determined in view of different manufacturing errors of various throttle valve lever actuating mechanisms with respect to the operating range from the idling position to the fully throttling position.

After the step 3, control goes to a step 4 in which the electronic controller 1 checks the engine rotational speed based on the detected signal from the engine speed sensor 1*a*, to determine whether the engine rotational speed has stabilized or not. If the engine rotational speed has stabilized in the step 4, then the electronic controller 13 confirms the present engine rotational speed Nn. The electronic controller 13 compares the engine rotational speed Nn with a preset maximum engine rotational speed $N_1$ in a step 5. If the maximum engine rotational speed $N_1$ is higher than the engine rotational speed Nn in the step 5 ($N_1 > Nn$), then control proceeds to a step 6 which checks the rate of change $\Delta Ne$ of the engine rotational speed. If $\Delta Ne > 0$, i.e., the present engine rotational speed is higher than the engine rotational speed in the previous number of steps which the step motor 9 was incremented, then control goes to a step 7. In the step 7, the electronic controller 13 adds one step to the present number of steps $\theta n$, and control returns to the step 4 for repeating the process.

Each time one step is added to the number of steps for the step motor 9, the engine rotational speed Nn is compared with the maximum engine rotational speed $N_1$ in the step 5. If $N_1 \geqq Nn$, i.e., the present engine rotational speed has reached the maximum engine rotational speed, then control goes from the step 5 to a step 8. In the step 8, the number of steps $\theta n$ at this time is learned by the electronic controller 13, and stored in the RAM as a maximum number of steps $\theta m$ at the time the accelerator pedal 11 is fully depressed.

If $\Delta Ne = 0$ in the step 6, then the electronic controller 13 assumes that the throttling lever 4 abuts against the fully throttling position stopper 6. In this case, control also goes to the step 8 in which the number of steps $\theta n$ at this time is learned and stored in the RAM as a maximum number of steps $\theta m$ at the time the accelerator pedal 11 is fully depressed.

After the maximum number of steps $\theta m$ for the step motor 9 has been stored, control goes to a step 9 in which the number of steps for driving the step motor 9 is reduced to zero, thereby canceling the aforesaid learning cycle.

The process of learning the maximum number of steps for driving the step motor 9 at the time the accelerator pedal 11 is fully depressed is effected except when the motor vehicle is normally driven. For example, it is effected while the motor vehicle is being braked by a parking brake with the motor vehicle at rest.

With the present invention, as described above, since the maximum number of steps for driving the step motor at the time the accelerator pedal is fully depressed is determined by a learning process, the maximum number of steps required to drive the step motor for the fully throttling position when the accelerator pedal is fully depressed can be determined for each of different engines or throttling lever actuating mechanisms. Accordingly, any hunting or out-of-control condition of the step motor which would otherwise result from a failure of a fully throttling position switch, or an engine power shortage due to a different maximum number of steps for the step motor, is prevented from occurring. Since the maximum number of steps for driving the step motor is not set by a signal from a fully throttling position switch, no such fully throttling position switch is required, and hence the cost of the system is reduced, and processes for adjusting or servicing such a fully throttling position switch are not necessary.

Although a certain preferred embodiment has been shown and described, it should be understood that many changes and modifications may be made therein without departing from the scope of the appended claims.

What is claimed is:

1. A learning control system for controlling the throttling of an internal combustion engine on a motor vehicle including an accelerator pedal and a gear selector, comprising:

a fuel supply device for supplying fuel to the internal combustion engine, said fuel supply device having a throttling lever for controlling the rate at which the fuel is supplied to the internal combustion engine;

a step motor for actuating said throttling lever;

means for controlling said step motor depending on the amount of depression of the accelerator pedal;

a select sensor for detecting a selected position of said gear selector;

an accelerator pedal movement sensor for detecting the amount of depression of the accelerator pedal;

an engine speed sensor for detecting the rotational speed of the internal combustion engine;

step incrementing means for incrementing the number of steps for driving said step motor when the selected position of said gear selector is at a neutral position and said accelerator pedal is fully depressed;

comparing means for comparing the engine rotational speed detected by said engine speed sensor with a preset maximum engine rotational speed each time the number of steps for driving said step motor is incremented;

learning means for determining the number of steps for driving said step motor when the engine rotational speed has reached said preset maximum engine rotational speed as determined by said comparing means; and memory means for storing said number of steps determined by said learning means as the number of steps at the time the accelerator pedal is fully depressed.

2. A learning control system according to claim 1, wherein said step incrementing means has means for initially producing a basic number of steps for driving said step motor.

3. A learning control system according to claim 2, wherein said basic number of steps is a minimum number of steps which said step motor is at least required to be incremented.

4. A learning control system according to claim 1, wherein said learning means has means for determining the number of steps for driving said step motor when the rate of change of the engine rotational speed becomes zero, irrespective of the engine rotational speed being lower than said preset maximum engine rotational speed.

* * * * *

UNITED STATES PATENT AND TRADEMARK OFFICE

CERTIFICATE OF CORRECTION

PATENT NO. : 5,168,450

DATED : December 1, 1992

INVENTOR(S) : DAIJI OHKUBO and SHUNSUKE KUROKI

It is certified that error appears in the above-identified patent and that said Letters Patent is hereby corrected as shown below:

Column 4, line 20, "1" should be --13--.

Signed and Sealed this

Sixteenth Day of November, 1993

*Attest:*

*Attesting Officer*

Bruce Lehman

BRUCE LEHMAN

*Commissioner of Patents and Trademarks*